US008950804B2

(12) United States Patent
Traut

(10) Patent No.: US 8,950,804 B2
(45) Date of Patent: Feb. 10, 2015

(54) MULTIFUNCTIONAL SEATING FURNITURE

(75) Inventor: Andreas Traut, Cologne (DE)

(73) Assignee: Gusto Products & Services GmbH, Cologne (DE)

( * ) Notice: Subject to any disclaimer, the term of this patent is extended or adjusted under 35 U.S.C. 154(b) by 0 days.

(21) Appl. No.: 13/995,922

(22) PCT Filed: Feb. 23, 2012

(86) PCT No.: PCT/EP2012/053094

§ 371 (c)(1),
(2), (4) Date: Jun. 19, 2013

(87) PCT Pub. No.: WO2012/113880

PCT Pub. Date: Aug. 30, 2012

(65) Prior Publication Data

US 2013/0328358 A1 Dec. 12, 2013

(30) Foreign Application Priority Data

Feb. 25, 2011 (EP) ..... 11001576

(51) Int. Cl.

| | |
|---|---|
| ***A47B 85/04*** | (2006.01) |
| ***A47B 83/02*** | (2006.01) |
| ***A47C 11/00*** | (2006.01) |
| ***A47C 7/70*** | (2006.01) |
| ***A47C 7/54*** | (2006.01) |

(52) U.S. Cl.

CPC ..... *A47B 83/02* (2013.01); *A47C 11/00* (2013.01); *A47C 7/70* (2013.01); *A47C 7/543* (2013.01)

USPC ..... 297/121; 297/122; 297/123; 297/124

(58) Field of Classification Search

USPC ..... 297/121, 122, 123, 124, 173

See application file for complete search history.

(56) References Cited

U.S. PATENT DOCUMENTS

| | | | | |
|---|---|---|---|---|
| 377,356 | A * | 1/1888 | Evans | 297/122 |
| 1,153,358 | A * | 9/1915 | Vaill, Jr. | 297/122 |
| 3,058,776 | A * | 10/1962 | Collum | 297/122 |
| 3,374,032 | A * | 3/1968 | Del Giudice | 297/394 |
| 7,025,415 | B1 * | 4/2006 | Wu | 297/119 |
| 7,207,623 | B2 * | 4/2007 | Milinov et al. | 297/124 |

* cited by examiner

*Primary Examiner* — Milton Nelson, Jr.

(74) *Attorney, Agent, or Firm* — Jennifer S. Stachniak; Robert W. Becker

(57) ABSTRACT

A bench includes a main frame (10), a sitting surface (11) and a backrest (12) which are each supported by the main frame. A sitting surface section (13) and a backrest section (14) are formed separately from the subregions (15, 16) of the sitting surface (11) and backrest (12). The sitting surface section (13) is pivotably connected to the backrest section (14) and can be lifted off from the main frame (10) and, by pivoting the backrest section (14) can be lifted out together with the backrest section (14) in a horizontal section (14) in a horizontal position at a distance from the sitting surface (11) of the seating furniture, forming an elongate arrangement of the backrest section (14) and sitting surface section (13).

8 Claims, 2 Drawing Sheets

MULTIFUNCTIONAL SEATING FURNITURE

BACKGROUND OF THE INVENTION

The instant application should be granted the priority dates of Feb. 25, 2011, the filing date of the corresponding European patent application 11001576.5, as well as Feb. 23, 2012, the filing date of the International patent application PCT/EP2012/053094

The invention relates to seating furniture in the form of a bench with a main frame and a supported sitting surface on the one hand and a backrest on the other hand.

As far as this type of seating furniture generally being known in use, a bench that is a seating furniture permits only the functioning of a seating area in particular of multiple people sitting next to one another on the sitting surface. Often situations occur in a storage surface in the form of a table top is desired. The addition of a special table, however, is generally not possible based on considerations of space; further, providing a special table furniture also means an additional use of space for whose storage as well as an additional manufacturing expense for the table furniture that is specially made.

SUMMARY OF THE INVENTION

The invention is based on the object of provide seating furniture of the above-noted type, which in addition to a pure seating function is suited for providing at least one further function.

The invention contemplates in its basic idea a seating furniture in the form of seating furniture in the form of a bench having a main frame (10) and first, a sitting surface (11) and second, a backrest (12) which are each supported by the main frame, in which seating furniture at least a sitting surface section (13) and a backrest section (14) are formed separately from the subregions (15, 16) of the sitting surface (11) and backrest (12) of the seating furniture situated next to the sections, and the sitting surface section (13) which is pivotably connected to the backrest section (14) can be lifted off from the main frame (10) and, by pivoting the backrest section (14), which is connected to the main frame (10) at its upper free end by means of a hinge (17), can be lifted out together with the backrest section (14) in a horizontal section (14) in a horizontal position at a distance from the sitting surface (11) of the seating furniture, forming an elongate arrangement of the backrest section (14) and sitting surface section (13), wherein a moveable support (19) which can be deployed and can be fixed to the lower side of the backrest section (14) is arranged on the main frame (10) for the purpose of fixing the backrest section (14), together with the sitting surface section (13) which is held thereon, in the lifted-out position.

An advantage associated with the present invention is that the inventive seating furniture first permits the functioning of a seat for multiple, preferably three people sitting on the seating surface. In addition, however, a backrest region separated from the continuous course of the backrest and the sitting surface can be lifted up together with the sitting surface region pivotably held thereon from the associated planes of the backrest and sitting surface, whereby the sitting surface region with the backrest region based on its pivoting capability on its upper end relative to the main frame can be lifted up from the associated planes of the sitting surface and backrest and brought into a plane lying at the upper end of the main frame with distance to the remaining sitting surface of the seating furniture and locked into this position by means of an adjustable support. With this pivoting motion of the backrest section, the sitting surface section coupled thereto by means of a hinge assumes an extended position with the backrest section. By means of this folding out, a table surface integrated as component of the seating furniture is produced, which is arranged with a suitable placement of the height of the backrest or of the main frame holding this with such a distance to the sitting surface, such that it provides comfortable seating for people sitting on the remaining subregions of the seating furniture or the adjusted table top. In this regard, the present invention includes the advantage that if necessary, a table top can be folded out from the bench construction and can be used in this function, without having to provide an additional table element.

Thus, the present invention extends to seating furniture with a correspondingly long extension and multiple backrest regions that can be folded out with sitting surface regions coupled thereto that are associated, respectively, in modifications with fixed subregions of backrests and sitting surfaces.

According to an exemplary embodiment of the invention, it is provided that on the backrest portion that can be lifted up, at least one bracket is arranged that supports the sitting surface section brought into an extended position with the backrest section. In this manner, the effectiveness of the pivotable connection, effected in particular via a hinge, of the sitting surface region and the backrest region to one another is defined and enables the stability of the folded out table top.

In order to increase the comfort of manipulation as well as seating, it can be provided that each of the subregions of sitting surfaces and backrest lying near the backrest section and sitting surface section that can be lifted up together is arranged displaceably on the main frame parallel to the backrest plane.

Alternatively or also additionally, it can be provided that each of the subregions of the sitting surfaces and backrest on the main frame near the backrest section and sitting surface section that can be lifted up tougher are rotatable about an axis oriented perpendicular to the plane of the sitting surface, so that by rotating the outerlying subregions of sitting surfaces and backrest, a seating position can be provided on the longitudinal side of the folded-out table.

According to a further embodiment of the invention, it can be provided that with the lifted-up backrest section, the sitting surface section coupled thereto by means of a hinge is foldable into a position projecting at an angle to the backrest angle. Thus, the folded-up backrest section is oriented as a sitting surface and the sitting surface section brought into a projecting position is oriented as a backrest of an elevated sitting space, for example for a child, so that the inventive sitting furniture in this position of the backrest section and sitting surface section offers different seating positions.

In this regard, it can be provided that the hinge arranged between the backrest section and sitting surface section is formed as a hinge that can be locked in the projecting position of the sitting surface section in order to fix the sitting surface section brought into the vertically projecting position into this position.

According to an embodiment of the invention, it can be provided that the main frame is made up of tube-like bars and the sitting surface and backrest are formed from individual wooden slats placed on and secured to associated bars.

BRIEF DESCRIPTION OF THE DRAWINGS

In the drawings, exemplary embodiments of the invention are illustrated, which will be described next. In the drawings.

DETAILED DESCRIPTION OF THE PREFERRED EMBODIMENTS

Figure 1:
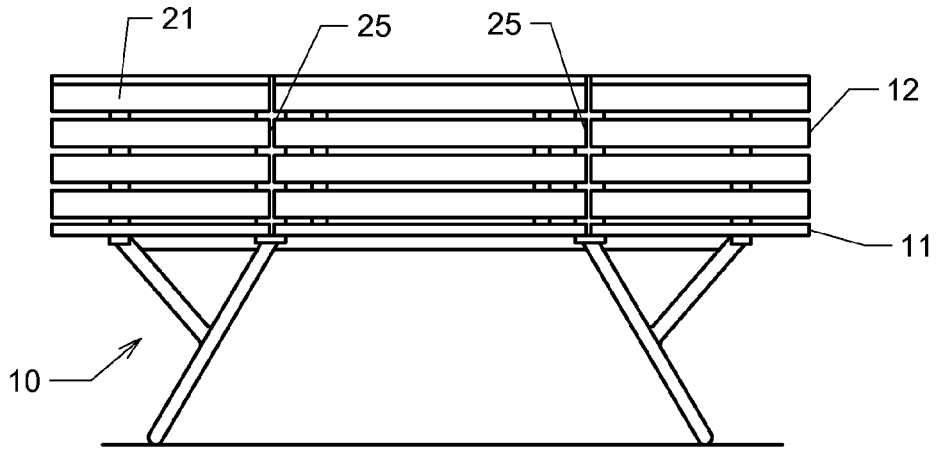
FIG. 1 shows seating furniture embodied as a bench in a front view.
Figure 2:
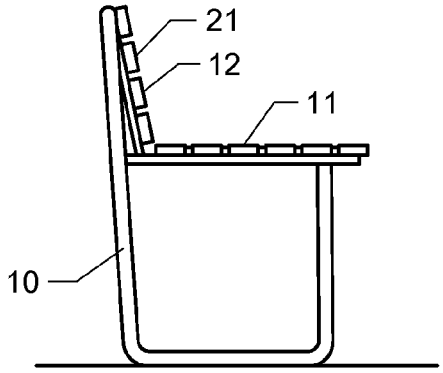
FIG. 2 shows the bench according to FIG. 1 in side view.

As first provided in FIGS. 1 and 2, the seating furniture embodied as a bench comprises a main frame 10 formed of tube-like rails, on which a sitting surface 11 and a backrest 12 are formed. Thus, the sitting surface 11 and the backrest 12 are each formed from wooden timbers 21 placed on associated rails of the main frame 10. The bench shown as an exemplary embodiment is therefore structure such that three people can sit comfortably next to one another on the bench.

In the center region of the seating furniture, a sitting surface section 13 and a backrest section 14 are formed along the separating line 25 separate from the adjacent sitting surface regions 15 or backrest regions 16 of sitting surface 11 and backrest 12 and are provided with supporting rails. According to the following description, the sitting surface section 13 and the backrest section 14 are moveable commonly relative to the main frame 10 with sitting surface region 15 and backrest region 16 remaining thereon.

Figure 3:
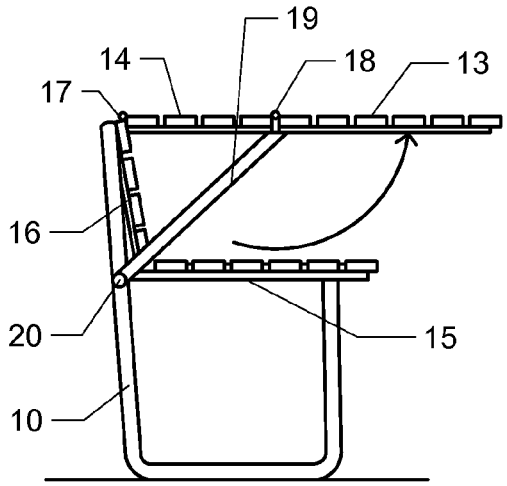
FIG. 3 shows the subject matter of FIG. 2 with the table area lifted up from the plane of the bench.
Figure 4:
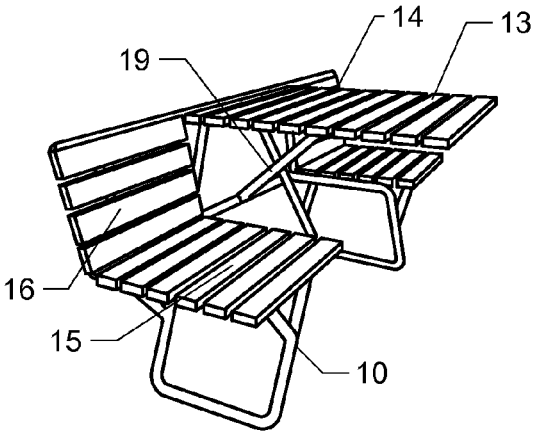
FIG. 4 shows the subject matter of FIG. 3 in a perspective view.

As shown in FIGS. 3 and 4, the backrest section 14 is arranged pivotably on the main frame 10 by means of a hinge 17 mounted on its upper end. The lower end of the backrest section 14 opposite to the hinge 17 is on the one hand, coupled with the sitting surface section 13 defined thereon vi a hinge 18 connecting the above-noted components. As shown in FIGS. 3 and 4, sitting surface section 13 and backrest section 14 can be lifted up from the associated planes of the sitting surface 11 and backrest 12, whereby in this manner, the sitting surface section 13 and backrest section 14 moved in an extended position and commonly have a horizontal position at a distance to the plane of the sitting surface 11. In this position, the backrest section 14, is fixable via a support 19 that is moveable about a pivot bearing 20 formed on the main frame 10, in that the support 19 is folded up and is secured in a suitable manner on the lower side of the backrest section 14.

For fixing the extended arrangement of the backrest section 14 and sitting surface section 13 freely projecting therefrom in the folded out position, brackets (not further illustrated) are mounted on the backrest section 14 and project in the direction of the sitting surface section 13, which form a bearing for the sitting surface section 13 and in this manner, stabilize the hinge 18 arranged between the backrest section 14 and sitting surface section 13.

As not illustrated further, it can be provided that the subregions 15 and 16 of the sitting surface 11 and backrest 12 remaining after lifting up of the backrest section 14 and sitting surface section 13 are displaceably arranged on the main frame 10 parallel to the backrest surface, whereby the distance between the remaining sitting regions and the folded-out table area is increased, so that a comfortable sitting position can be provided.

Alternatively or also additionally, it can be provided that the above-mentioned subregions 15, 16 of sitting surface 11 and backrest 12 are rotatably about an axis oriented perpendicular to the plane of the sitting surface. In this regard, the sitting regions remaining on the seating furniture can be changed in their orientation to the table folded out from the seating furniture, whereby in particular, with a combination of the rotatability with the longitudinal displaceability, the distance of the sitting regions from the table region can be increased.

Figure 7:
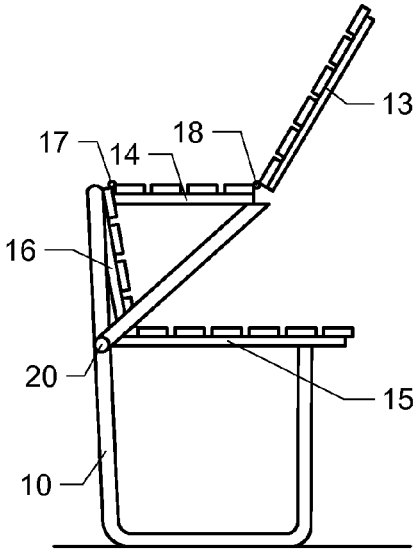
FIG. 7 shows the bench with an elevated seating space lifted up from the bench surface in a lateral view according to FIG. 3.
Figure 5:
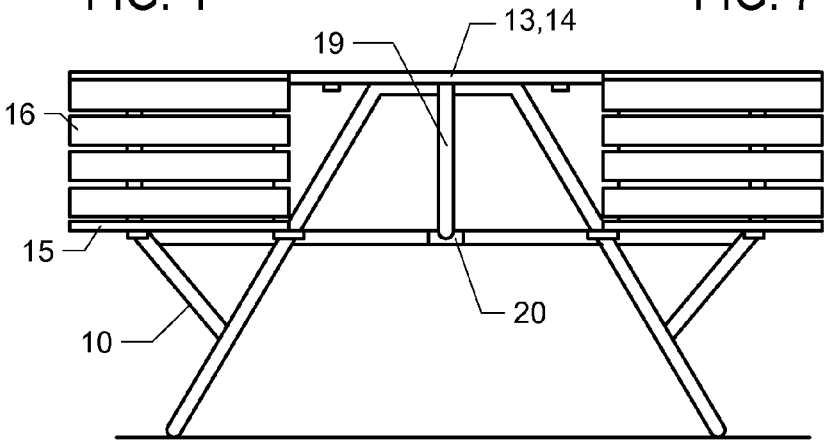
FIG. 5 shows the bench with table area in a front view.
Figure 6:
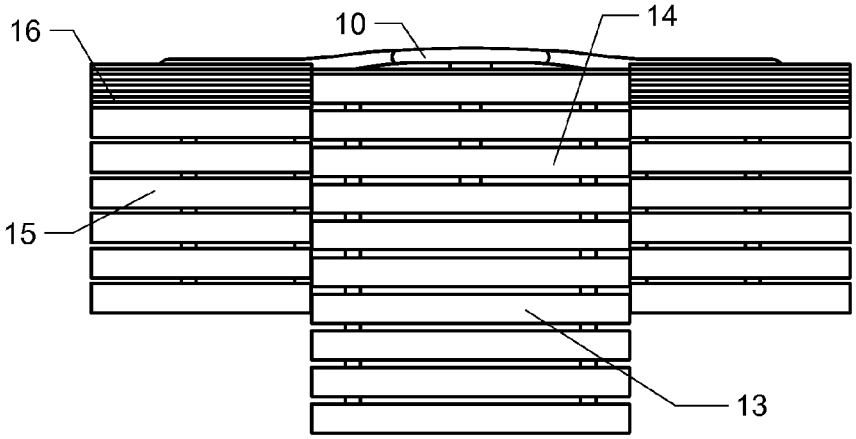
FIG. 6 shows the subject matter of FIG. 5 in a plan view.

As shown finally in FIG. 7, it also can be provided that the sitting surface section 13 is foldable with a lifted-out backrest section 14 about the hinge 18 provided therebetween into a position projecting at an angle to the backrest section 14, in which a further, elevated seating possibility is provided commonly from the backrest region 14 and sitting surface region 13, in which the backrest portion 14 acts as a sitting surface and the sitting surface region 13 acts as a backrest of this elevated seat.

The features of the subject matter of this disclosure disclosed in the foregoing description, the patent claims, and abstract and the drawings can be used individually as well as in any combination in order to realize the invention in its various embodiments.

The specification incorporates by reference the disclosure of EP 11001576.5, filed Feb. 25, 2011, as well as International application PCT/EP2012/053094, filed Feb. 23, 2012.

The present invention is, of course, in no way restricted to the specific disclosure of the specification and drawings, but also encompasses any modifications within the scope of the appended claims.

The invention claimed is:

1. Seating furniture formed as a bench, comprising:

a main frame (10);

a sitting surface (11) and a backrest (12) each supported by the main frame and each having subregions (15, 16);

at least one sitting surface section (13) and a backrest section (14) formed separately from the subregions (15, 16), wherein the backrest section (14) is connected to the main frame (10) at an upper free end via a hinge (17), wherein the sitting surface section (13) is pivotably connected to the backrest section (14) and is liftable off from the main frame (10) and, wherein by pivoting the backrest section (14), the sitting surface section (13) is liftable out together with the backrest section (14) in a horizontal section in a horizontal position at a distance from the sitting surface (11) thereby forming an elongate arrangement of the backrest section (14) and sitting surface section (13);

a moveable support (19) fixed to the lower side of the backrest section (14) is arranged on the main frame (10) and is adapted to fix the backrest section (14), together with the sitting surface section (13) which is held thereon, in a lifted-out position.

2. Seating furniture according to claim 1, further comprising at least one angle support supporting the sitting surface section (13) that is brought into an elongate arrangement with the backrest section (14), wherein said at least one angle support is arranged on the backrest section (14) that is configured to be lifted out.

3. Seating furniture according to claim 1, wherein each of the subregions (15, 16) lying adjacent to the backrest section (14) and sitting surface section (13) that are liftable out together from the sitting surface (11) and backrest (12) on the main frame (10) are arranged displaceably parallel to a plane of the backrest plane.

4. Seating furniture according to claim 1, wherein each of the subregions (15, 16) lying adjacent to the backrest section (14) and sitting surface section (13) that are liftable out together from the sitting surface (11) and backrest (12) on the main frame (10) are rotatable about an axis that is oriented perpendicular to a plane of the sitting surface (11).

5. Seating furniture according to claim 1, wherein when the backrest section (14) is in a lifted-up position, the sitting surface section (13) coupled thereto via a hinge (18) is foldable in a position projecting at an angle to the backrest section (14).

6. Seating furniture according to claim 5, wherein the hinge (18) arranged between the backrest section (14) and sitting surface section (13) is formed as a locking hinge in an extended position of the sitting surface section (13).

7. Seating furniture according to claim 1, wherein the main frame (10) is made from tubular rails.

8. Seating furniture according to claim 7, wherein the sitting surface (11) and backrest (12) are formed from wooden slats individually placed on associated rails and attached thereto.

* * * * *